United States Patent [19]

Brabant

[11] 4,397,347

[45] Aug. 9, 1983

[54] FOLDABLE PANEL OR DOOR

[76] Inventor: Henri Brabant, La Cote, 43220 Dunieres, France

[21] Appl. No.: 311,455

[22] Filed: Oct. 14, 1981

[30] Foreign Application Priority Data

Aug. 12, 1980 [FR] France ..... 80 17766

[51] Int. Cl.[3] ..... E06B 3/94

[52] U.S. Cl. ..... 160/231 R; 160/84 R

[58] Field of Search ..... 428/12, 904.4; 160/84 R, 231 R

[56] References Cited

U.S. PATENT DOCUMENTS 2,667,218 1/1954 Collins ..... 160/84 R 4,083,395 4/1978 Romano ..... 160/84 R

*Primary Examiner*—Henry F. Epstein

*Attorney, Agent, or Firm*—Cushman, Darby & Cushman

[57] ABSTRACT

There is disclosed a foldable panel made out of two superimposed web surfaces having major transparent portions, the web surfaces being secured one to each other by successive pairs of connection lines defining therebetween pockets within which are enclosed bands of reduced thickness out of an insulating material and formed with a plurality of transversing holes to permit to see through the panel. Between the pockets, the connection lines further define sheaths for receiving hinge tubes, some of which have laterally protruding ends with rollers cooperating with side guiding tracks for the panel.

4 Claims, 5 Drawing Figures

FIG. 4
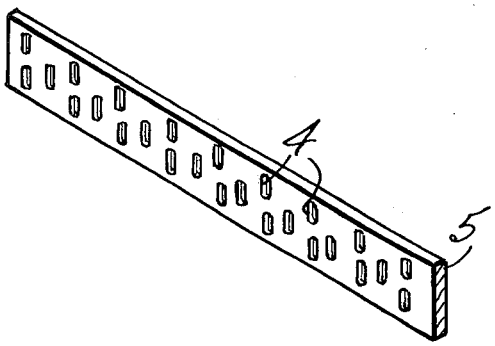
FIG. 3
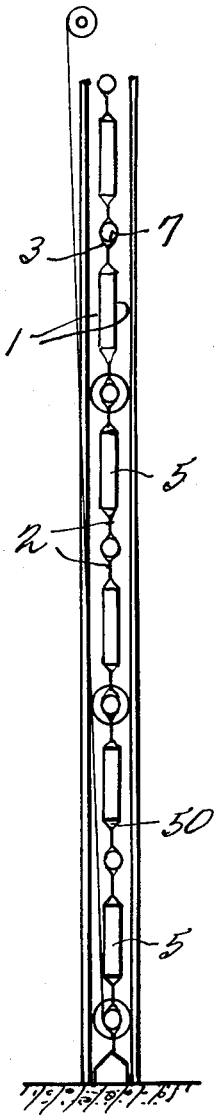
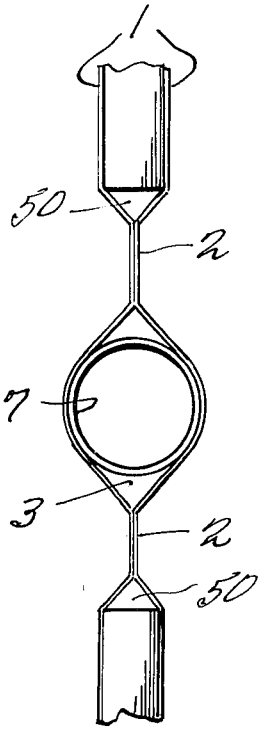
FIG. 5

FOLDABLE PANEL OR DOOR

BACKGROUND OF THE INVENTION

The present invention relates to folding panels made of water-proof thin fabric or films, which are adapted to form moveable partition walls or doors which can be folded in an accordion-shape or in a zigzag manner.

Such foldable panels, typically of the vertically folding type, are utilized for selectively insulating premises and closing or dimming apertures inside or outside industrial buildings. The panels have to be designed to withstand medium winds and to be tight so as to prevent important heat losses.

In a known arrangement, the flexible and foldable panel is formed of different sections, each made of two water-proof non-transparent pieces of fabric of identical dimensions, which are mounted one parallel to the other by means of screws or rivets on several parallel aluminum sections having a length in the transversal direction of the panel greater than the transversal width of the pieces of fabric and arranged at regular intervals all over the height of the panel. The protruding ends of said sections support rollers which are guidingly supported on two parallel tracks arranged vertically on both lateral sides of the aperture to be closed or partitioned. By means of a cable and winch mechanism the lowermost section can be displaced up or down and, when raised, drives the other sections upwardly as the panel is opened, said latter being progressively folded in a zigzag manner in the upper part of the aperture.

A disadvantage of such a panel is that it shows poor insulating properties by reason of the aluminum sections interposed between the elementary panel sections made of two joined fabric pieces, whereby there is no convenient closure of the vertical lateral spaces between two aluminum sections which results in the existence of air circulation paths at the level of the vertical lateral parts of the panel, thereby preventing convenient saving of heating energy. On the other hand, such panels present mounting problems for assembling the fabric pieces and the aluminum sections by means of the screws or rivets, with the appended drawbacks of increased manufacturing costs. Further, utilization of non-transparent fabric pieces does not insure convenient safety in industrial plants and hinders saving of light energy.

In order to obviate some of said drawbacks, foldable panels have also been proposed which comprise a single non-transparent cloth or web, eventually provided with one or several transversally extending windows out of flexible transparent plastic material bonded on openings formed within the non-transparent cloth. Onto said cloth are welded several cloth bands of reduced width having a length corresponding to the transversal width of the panel, said bands being mounted at regular spaces over the height of the panel. The thus secured bands are shaped to form transversally extending sheaths into which are inserted metallic tubes, the opposite ends of which protrude from the sheaths so as to be each guided within parallel C-shaped sections arranged vertically on both sides of the aperture to be closed. When the foldable panel is unfolded to close said aperture, the metallic tubes are thus suspended at regular intervals. In order to make the thus closed aperture free, the panel is folded in a zigzag manner by raising the lowermost tube by means of straps which are slidingly guided in rings mounted on the intermediary tubes. When the lowermost tube is raised, it drives successively the different intermediary tubes upwardly so as to group same in the upper part of the aperture, the foldable panel being thus completely folded in accordion.

With such panels, the thin cloth shows reduced insulating properties, whereby causing great heat losses in the heated buildings and preventing substantial energy saving. Additionally, the straps for raising the panel are slidingly received within the rings arranged on the intermediary upper tube and friction between the rings and the straps cause rapidly damages to said latter. On the other hand, the cloth which has been cut to permit protrusion of the rings connected to the tubes show, at the level of said cut portions, zones of reduced mechanical strength.

Accordingly, it is an object of the present invention to provide a simple and efficient foldable panel, typically a vertically foldable and extendable panel, which obviates said drawbacks of the prior art techniques in permitting a substantial reduction of the heat losses, whereby allowing to save heating energy, the panel being at least partially transparent, whereby offering, due to the convenient visibility through the panel, an improved safety in industrial utilizations wherein displacements of persons or vehicles or loads are numerous and fast. According to another object of the invention, the thus provided panel permits to save electrical energy which may be required for lighting the premises during the day.

SUMMARY OF THE INVENTION

According to the invention, the foldable panel is made out of an at least partially transparent sheet material which is doubled to form parallel separate transversally extending pockets for receiving bands out of an insulating material, said bands of insulating material being formed with holes in zones thereof corresponding at least to some transparent parts of the sheet material so as to permit to see through the panel.

The panel may comprise non-transparent and transparent breadths of sheet material which are mutually adjoined, i.e. with a transparent breadth superimposed to another transparent breadth, so as to have a final door or curtain having a major transparent surface. According to another embodiment of the invention, use can be made of a single film or cloth having non-transparent and transparent zones, said film or cloth being folded back on itself to provide a dual thickness curtain having, as in the preceding embodiment, mating transparent and non-transparent zones to provide a curtain having a major transparent surface. The panel can also be realized out of an entirely transparent folded sheet material.

With such an arrangement, there is provided a foldable door and curtain exhibiting improved and controllable insulating properties by reason of the double-thickness character of the curtain and of the insertion in the thus formed pockets of bands made of a highly insulating material, while said door is at least partially transparent by reason of the holes formed in the bands of insulating material at least in the zones thereof corresponding to the transparent zones of the sheet material.

According to another feature of the invention, the panel is realized by uniting two webs or films of the above mentioned class which are mutually secured one against the other along pairs of connection lines defining therebetween the pockets for receiving the bands of insulating material. More specifically, two adjacent connection lines of two successive pairs of connection lines further define therebetween a transversally extending sheath within which is inserted a rigid tube which will serve as a hinge between adjacent semi-rigid sections of the foldable panel. In the preferential utilization of the foldable panel according to the invention to form a wall or curtain which is vertically foldable in a zigzag manner with horizontal pleats, the weight of the rigid tubes may be regularly distributed over the two interconnected superposed webs, whereby preventing an excessive fatigue of one of said webs.

BRIEF DESCRIPTION OF THE DRAWINGS

In order that the present invention may be readily understood, the following description is given, by way of example, with reference to the accompanying drawings, in which:

FIG. 3 is a vertical cross section of the extended foldable panel of FIG. 1;

FIG. 4 is a perspective view of a band of insulating material to be mounted within the pockets of the foldable panel; and, FIG. 5 is a vertical cross section, at a greater scale, of the foldable panel and shows the junction lines for interconnecting the two adjoined superimposed webs so as to form the pockets for the bands and the sheaths for receiving the rigid tubes.

DETAILED DESCRIPTION

Figure 1:
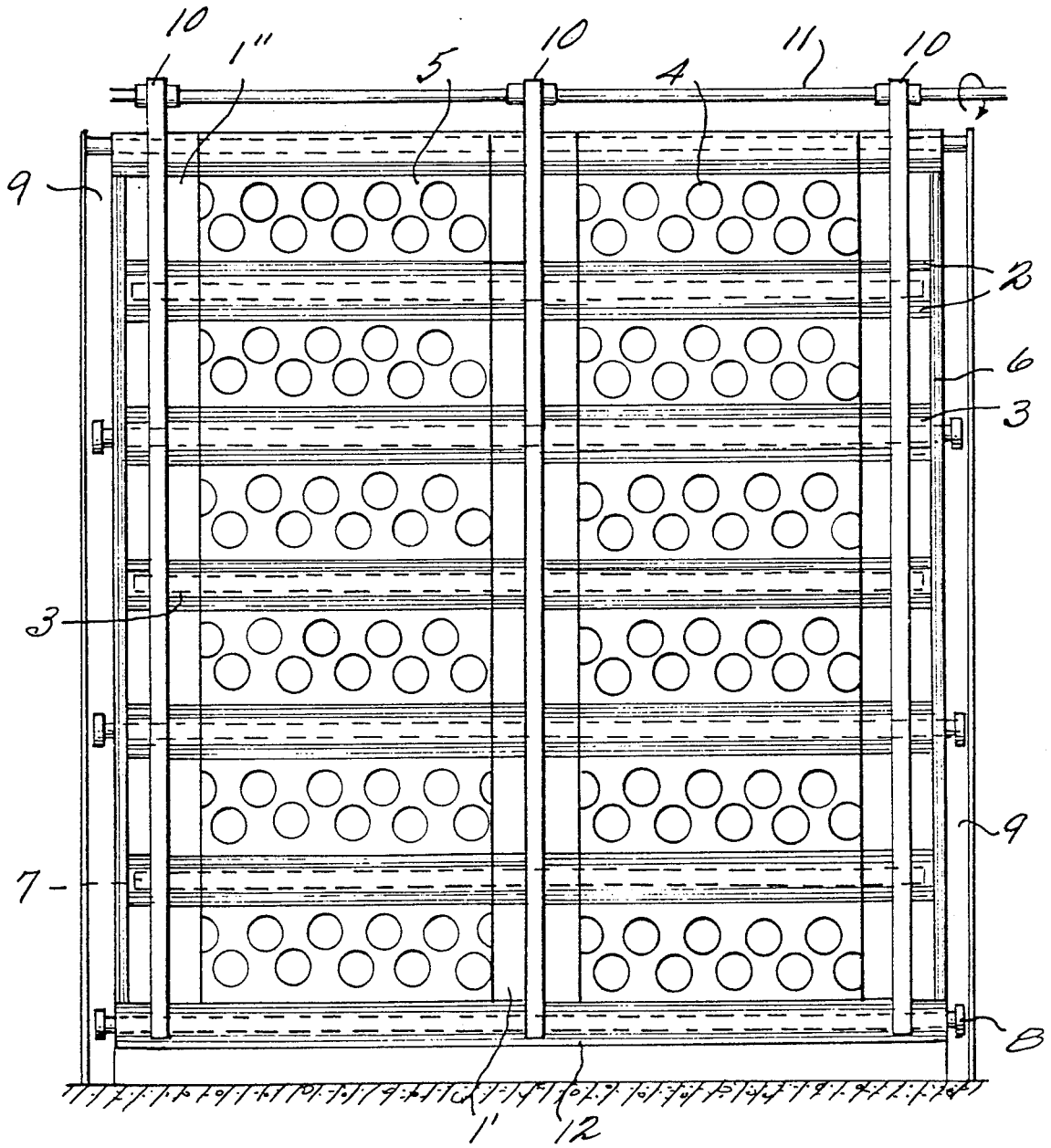
FIG. 1 is a front view of a vertical foldable panel according to the invention, in extended configuration for closing an aperture.

As illustrated in the drawings, the foldable panel forming a moveable partitioning wall according to the invention comprises an extendable and foldable surface made of two at least partially transparent webs 1 having the same dimensions and which are adjoined and secured one to each other by pairs of connection lines 2 (welded or sewn connections) extending all over the transversal width of the webs, said pairs of connection lines being provided at regular intervals all over the height of the panel. The two welding lines of each pair of connection lines define therebetween a pocket 50 forming a recess for receiving a band made of an insulating material 5. Additionally, two adjacent connection lines of two successive pairs of connection lines 2 define therebetween a sheath 3 forming a recess for receiving a rigid tube 7. In the embodiment illustrated in FIGS. 1 and 2, the webs have a major transparent surface but comprise parallel separated vertical zones or breadths 1' constituted by non-transparent breadths out of waterproof cloth or film material, the paired main transparent surfaces being constituted by transparent breadths of a transparent or translucent plastic film, for instance out of polyvinyl chloride. As above mentioned, in such an arrangement, the transparent breadths on one hand and the non-transparent breadths on the other hand are mutually paired.

The bands 5 out of an insulating material are advantageously made out of a non-transparent or translucent flexible plastic material, for instance polyurethane, or out of any convenient material exhibiting good heat insulating properties. Said bands 5 are formed with round holes 4 (the holes having eventually other shapes), which are great enough and in a sufficient number to permit to see easily through the band. The insulating bands 5 have a height corresponding substantially to the height of the pockets 50 of the panel, a length corresponding substantially to the transversal width of the two superimposed adjoined webs, and a thickness which is chosen depending upon the required insulating properties for the final panel. After each insulating band 5 has been inserted between the two superimposed webs, said latter are welded or sewn according to the pairs of connection lines 2 on both sides of each insulating band so as to form tight insulating see-through cushions within which the holes formed in the insulating bands form cells including trapped air which are also insulating while however allowing to see through the panel. The bands 5 out of the insulating material are further sealed in the web material by lateral or vertical side welding or sewing lines 6 which close the opposite ends of the pockets 50 at the level of the vertical lateral edges of the two superimposed webs forming the panel.

Figure 2:
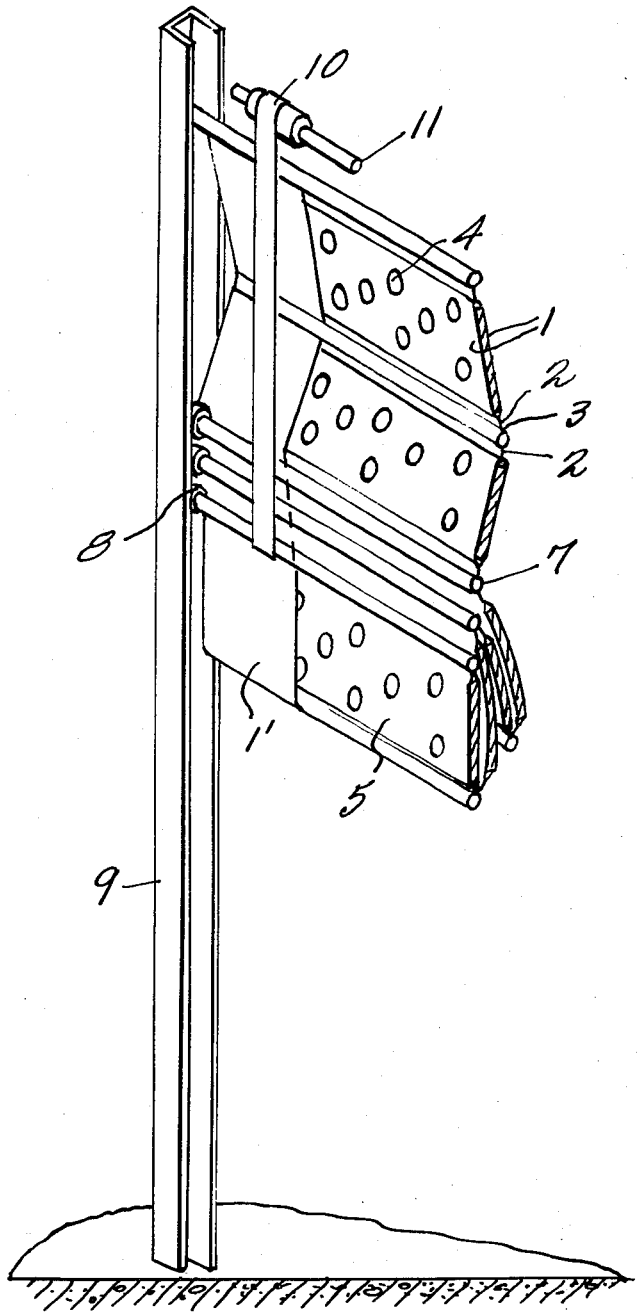
FIG. 2 is a fragmentary perspective view illustrating the panel of FIG. 1 in an intermediate accordion-like folded configuration.

In the different sheaths 3 are located rigid hinge tubes or bars 7. The lowermost tube and each second tube in the vertical direction has a length determined so as to protrude from each lateral side of the panel, said protruding ends of the tubes having ball bearings or rollers 8 received within C-shaped vertical parallel tracks 9 mounted on the opposite lateral vertical edges of the aperture to be closed. The other intermediate tubes 7 have a length slightly lesser than the transversal width of the panel and are trapped between the two adjoined webs 1 by the lateral vertical connection lines 6. On FIGS. 1 and 2 are also illustrated the manoeuvring straps 10 which are connected to the lowermost tube 7 of the panel and which are adapted to be wound around a shaft 11 which extends transversally above the foldable panel and which is rotatably driven by any convenient mechanical or electro-mechanical means. As best seen in FIG. 2, when the straps 10 are progressively wound around the shaft 11, they pull upwardly the lowermost tube, which in turns displaces or drives upwardly the intermediary tubes towards the upper part of the aperture, and the panel is folded in a zigzag manner or accordion-like with the thus formed successive folds falling downwardly by reason of the intermediary short tubes 7 which are trapped within the sheet material of the panel and which are not guided at their opposite ends in the tracks 9.

The foregoing detailed description is to be understood as given by way of illustration and example, while the combination and arrangement of the parts may be changed without departing from the spirit and the scope of the appended claims. Thus, while the invention has been disclosed in connection with vertically foldable and extendable panels, it is also equally convenient for realizing horizontally foldable doors or extensible partition walls. In such a case, the rigid tubes 7 which protrude laterally from the sides of the panel may be connected to carriages having rollers and guidingly supported in tracks having the shape of an inverted U, the vertically extending wings of which have further terminal or distal portions folded back inwardly. The foldable panel can also find utilization for covering swimming pools or as opening ceilings, while being guided laterally by parallel rails or tracks.

What I claim is:

1. A foldable panel for forming a vertically foldable or extendable wall or door comprising:

two substantially coextensive webs which are secured to each other along pairs of parallel transversely extending connection lines defining between said pairs interconnected parallel pockets, said webs being made of a flexible sheet material having at least partially transparent vertical zones, the lines of each of said pairs defining therebetween a sheath, a rigid hinge tube within each sheath, a band of flexible insulating material within each of said pockets, said bands having zones corresponding to said transparent zones of said webs formed with holes having air trapped therein between said webs and being of sufficient size and number to provide good visibility through said panel.

2. The panel of claim 1, wherein each second said tube has opposite ends protruding from said sheath and supporting roller means adapted for cooperating with a side track means.

3. The panel of claim 2, wherein each other said tube has a reduced length and is totally trapped between said two web surfaces, said bands of insulating material being also totally trapped between said webs.

4. The panel of claim 3, wherein said webs are made of translucent polyvinyl chloride.

* * * * *